US007172399B2

(12) United States Patent
Reutter

(10) Patent No.: US 7,172,399 B2
(45) Date of Patent: Feb. 6, 2007

(54) SPIN BEAM

(75) Inventor: Tilman Reutter, Schonboken (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 340 days.

(21) Appl. No.: 10/733,697

(22) Filed: Dec. 11, 2003

(65) Prior Publication Data

US 2004/0124551 A1 Jul. 1, 2004

(30) Foreign Application Priority Data

Feb. 13, 2002 (DE) ..... 102 58 261

(51) Int. Cl.
*D01D 5/084* (2006.01)

(52) U.S. Cl. ..... 425/143; 425/378.2; 425/382.2; 264/39; 264/169; 264/211.22

(58) Field of Classification Search ..... 425/143, 425/378.2, 382.2; 264/39, 169, 211.22
See application file for complete search history.

(56) References Cited

U.S. PATENT DOCUMENTS

| | | | | |
|---|---|---|---|---|
| 3,051,986 | A | 9/1962 | Hoffmann | |
| 3,626,156 | A | 12/1971 | Takizawa | |
| 3,767,347 | A * | 10/1973 | Landoni | 425/378.2 |
| 3,864,068 | A * | 2/1975 | Flakne | 425/192 R |
| 4,698,008 | A | 10/1987 | Lenk et al. | |
| 5,268,132 | A * | 12/1993 | Keilert et al. | 264/169 |
| 5,662,947 | A | 9/1997 | Kretzschman et al. | |
| 5,733,586 | A | 3/1998 | Horwegh et al. | |
| 5,866,050 | A * | 2/1999 | Krauss et al. | 264/40.6 |
| 5,922,362 | A | 7/1999 | Schippers et al. | |
| 5,927,590 | A | 7/1999 | Horwegh et al. | |
| 5,992,453 | A * | 11/1999 | Zimmer | 137/561 A |
| 6,083,432 | A | 7/2000 | Schafer | |
| 6,240,715 | B1 | 6/2001 | Bruss et al. | |
| 6,261,080 | B1 | 7/2001 | Schröter et al. | |

FOREIGN PATENT DOCUMENTS

| | | |
|---|---|---|
| CA | 2 334 866 | 12/2000 |
| DE | 19 59 180 | 6/1970 |
| DE | 23 10 463 | 9/1974 |
| DE | 195 40 907 A1 | 5/1996 |

(Continued)

OTHER PUBLICATIONS

Rieter Automatik GMBH Spin Beams Mar. 2002, pp. 1-4.

(Continued)

*Primary Examiner*—Joseph S. Del Sole
(74) *Attorney, Agent, or Firm*—Alston & Bird LLP

(57) ABSTRACT

An apparatus for spinning melt-spun filament yarns including a spin beam is disclosed. A polymer melt fed to a spin beam is distributed within the spin beam to a plurality of spinning cans mounted on the spin beam. To reduce costs to the manufacturer for ensuring ease of disassembly of the spin beam, as well as to avoid the need for disassembling the spin beam and having a furnace on hand, the spin beam is provided with an integrated or removably attachable regenerative heater by which the melt-conducting components of the spin beam can be heated to a regeneration temperature of between about 450 to 550° C. to pyrolytically remove the deposits.

17 Claims, 3 Drawing Sheets

FOREIGN PATENT DOCUMENTS

| | | | |
|---|---|---|---|
| EP | 0 163 248 | A2 | 4/1985 |
| EP | 0 663 024 | A1 | 7/1995 |
| EP | 0 742 851 | A1 | 11/1996 |
| EP | 0 748 397 | A1 | 12/1996 |
| EP | 0 828 017 | A2 | 3/1998 |
| EP | 1 028 181 | A1 | 8/2000 |
| WO | WO 98/27253 | A1 | 6/1998 |
| WO | WO 99/51800 | | 10/1999 |
| WO | WO 00/68475 | A1 | 11/2000 |

OTHER PUBLICATIONS

Patent Abstracts of Japan Bd. 2002, Nr. 12, Dec. 12, 2002 & JP 2002 227026 A (Teijin Ltd), Aug. 14, 2002 Abstract.

Patent Abstracts of Japan Bd. 0140, Nr. 37 (C-680), Jan. 24, 1990 & JP 1 272807 A (Toray Ind Inc), Oct. 31, 1989 Abstract.

* cited by examiner

SPIN BEAM

BACKGROUND OF INVENTION

Apparatuses used for melt spinning of synthetic threads are known from German Patent Application 195 40 907 A1, for example.

To this end, a polymer melt is fed to a spin beam from a melt source, for example an extruder or a polymerization unit. Inside the spin beam the melt is fed to usually one, or, by use of a distributor, multiple, metering pumps, which distribute the melt at a defined volumetric flow rate to spin cans in which the filaments are formed. The elements of the spin beam, that is, the distributor, metering pumps, piping, and spin cans, are all heated together and are enclosed by insulation.

Occasionally the physical characteristics of the polymers used for the melt spinning are altered under the influence of temperature and time. Polyamide 6.6, for example, tends to undergo post-polycondensation, resulting in an unmeltable hardening of the material and thus to deposits, or, in extreme cases, to plugging, in the lines. For this reason, in the design of spin beam special attention is given to a uniform, short residence time of the melt in the spin beam, and to a very uniform temperature. The residence time of the melt can be made uniform by mechanically optimizing the flow in the lines. Uniform temperature of the spin beam is achieved by heating, using a heat transfer medium contained as a liquid/gas mixture in the spin beam. Heat is transferred to the cold locations by condensation of the gaseous portion of the fluid on same, so that a very uniform temperature corresponding to the boiling point of the heat transfer medium is achieved within the spin beam. It is also known to use oil as heat transfer medium, or electrical heating.

Despite the above-described constructive measures, spinning of polyamide 6.6 is not regarded favorably by manufacturers of synthetic fibers. If post-polycondensed polymer forms, resulting in plugging of the lines, the spin beam must be completely disassembled and the plugged elements regenerated in an external furnace, i.e.; pyrolytically cleaned at temperatures of 450 to 550° C. This situation may occur in particular upon unit shutdowns, or when there is insufficient polymer throughput. However, even without the occurrence of an unexpected operating state it may be necessary to regenerate the spin beam at certain time intervals.

The cost of regeneration deters small, inexperienced synthetic fiber manufacturers from processing critical polymers such as polyamide 6.6.

The design of a spin beam must take into account ease of disassembly and the ability to dismantle into small units. Appropriate flanges on piping, using sealants, must be provided.

BRIEF SUMMARY OF INVENTION

The object of the present invention, therefore, is to further refine an apparatus for spinning according to the prior art, thus allowing the spin beam to be regenerated without costly disassembly.

This object is achieved by the invention by providing the spin beam with regeneration heating, either permanently installed or temporarily attachable to the spin beam, which heats the spin beam to the required pyrolysis temperature as needed. The advantage of the invention lies in the fact that the regeneration process can thus take place without costly disassembly of the spin beam. The spin beam may be constructed as a single unit so that removable flanges and other leak hazards are not necessary, resulting in a spin beam with a more economical and simple design.

In the case of a spin beam heated by a heat transfer medium, it is usually not possible with this heating principle to achieve the pyrolysis temperature required for the regeneration process. For this reason separate regeneration heating is provided for the regeneration process in the form of electrical resistance heating, a hot air blower, or the like.

To carry out the regeneration process, the regeneration heating is able to heat the melt-conducting components to temperatures above the operating temperature. This temperature is preferably in the range of 450 to 550° C., which thermally destroys the organic deposits.

If the spin beam is heated by an electrical heating unit, the unit can simultaneously be put to practical use as regeneration heating, and is capable of heating the spin beam to the regeneration temperature.

The thermal destruction of the organic deposits generates gases and vapors in the spin beam. For this reason, in one preferred refinement of the invention means are provided for exhausting the generated gases and vapors. In one particularly preferred refinement the exhausted gases and vapors are filtered.

For the case in which the spin beam is heated using a heat transfer medium, in one advantageous refinement of the invention means are provided to drain off the heat transfer medium for the duration of the regeneration process, and to store it outside the spin beam which is heated to regeneration temperature. In one particularly advantageous refinement of the invention, means are provided to remove the vapors produced by evaporation of the heat transfer medium during the regeneration process.

One exemplary embodiment is described in greater detail below, with reference to the accompanying drawings.

DETAILED DESCRIPTION

Figure 1:
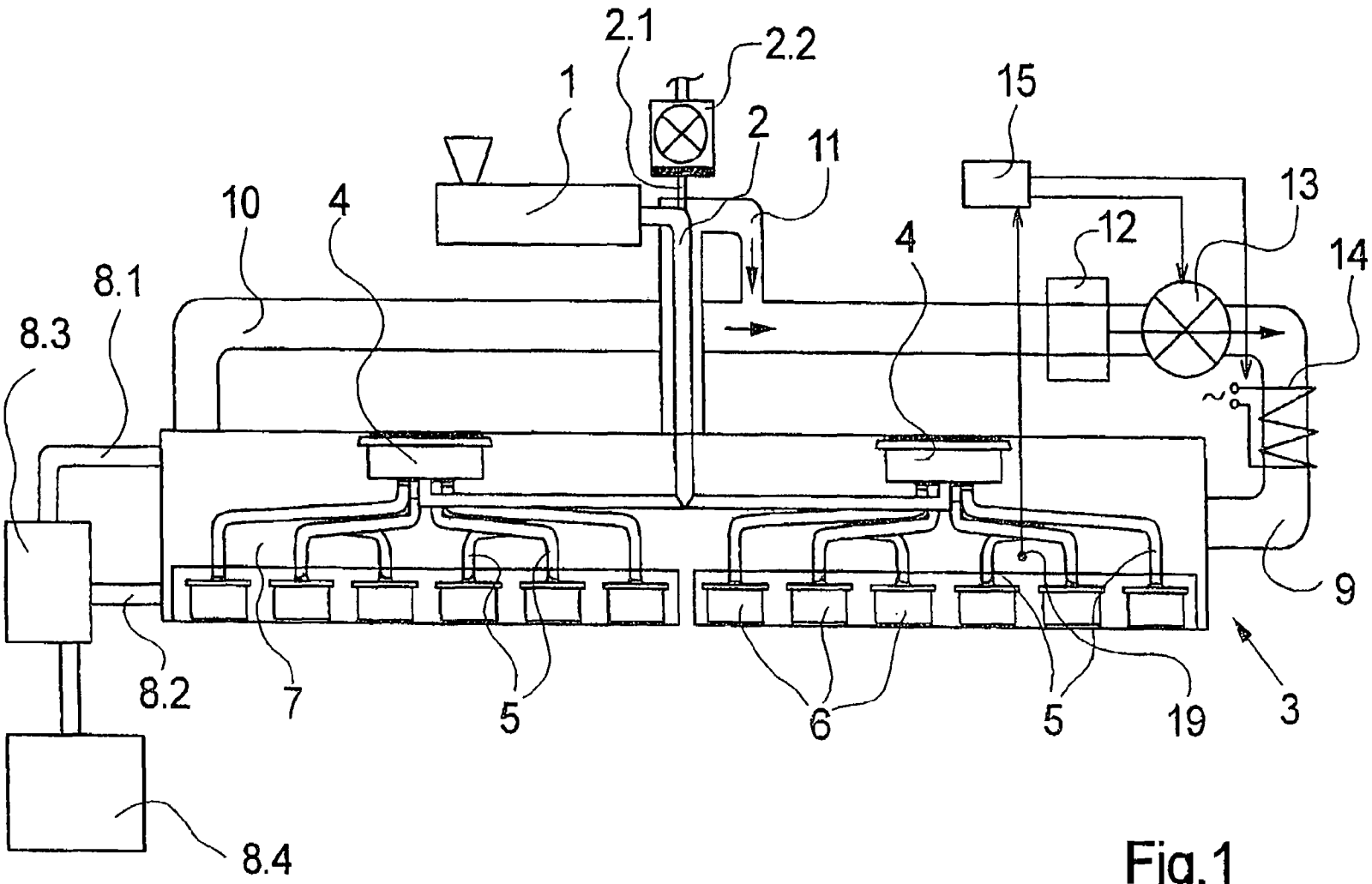
FIG. 1 shows a section through an apparatus for spinning melt-spun filament yarns according to the present invention.

FIG. 1 illustrates in sectional view an inventive apparatus for spinning. A polymer melt is fed from an extruder 1 via a melt feed line 2 to spin beam 3. Instead of extruder 1, a direct polycondensation reactor may be used here as the source for the polymer melt. Inside spin beam 3, melt feed line 2 is apportioned to two spinning pumps 4. Spinning pumps 4 distribute the polymer melt, metered via distribution lines 5, to the individual spinning cans, not shown, which are accommodated in spinning can receivers 6. The filaments for forming the thread are extruded from the polymer melt in these spinning cans. The number of spinning can receivers 6 as well as the number of spinning pumps 4 are chosen here by way of example.

Inside spin beam 3, a cavity 7 is formed so that it may be filled with a heat transfer medium. This heat transfer medium circulates through an operational heating means 8.3 via an inlet 8.1 and an outlet 8.2. Spin beam 3 is thus heated to operating temperature by operational heating means 8.3, an operating temperature of 250 to 330° C. being common.

The use of oil or Diphyl as heat transfer medium is known. Diphyl is a trademark of Lanxess Deutschland GmbH, and is used in association with a family of heat transfer fluids. Diphyl is advantageous here since it is present in spin beam 3 in the liquid and the gaseous phase, so that cold components of spin beam 3 are heated in a targeted manner by the heat of condensation produced by condensation of the gaseous Diphyl heat transfer fluid. For the sake of brevity the operational heating of melt feed line 2, which cooperates with operational heating 8.3 or is operated separately, is not illustrated here.

Although the length of divided feed line 2, as well as the length of each distribution line 5 to the particular spinning can receiver 6, is the same for every branch, and therefore the residence time of the melt in the melt-conducting parts of spin beam 3 is equal for each spinning can receiver 6, degradation of the polymer can occur in spite of the uniform temperature in spin beam 3.

For this reason, in FIG. 1 spin beam 3 is provided with regeneration heating by which spin beam 3 can be heated to a regeneration temperature above the operating temperature.

In this case the regeneration heating is a hot air blower comprising hot air exhaust 10, filter 12, blower 13, regeneration heating means 14, and hot air feed 9.

To carry out the regeneration heating process, the heat transfer medium contained in cavity 7 can be transferred into a collection reservoir 8.4. The regeneration heating causes hot air to flow through cavity 7, which is now filled only with air, long enough to heat the components inside spin beam 3 to the regeneration temperature. To this end, blower 13 directs the air through regeneration heating means 14 which heats the air flowing through. The hot air is led via hot air feed 9 through spin beam 3, and is returned via hot air exhaust 10. Any vapors formed from the residues of the heat transfer medium are collected by filter 12. Parallel to the above-described path of the hot air through spin beam 3, in the example in FIG. 1 a second hot air duct 11 is provided which heats melt feed line 2, likewise to the regeneration temperature.

Control means 15 detect the temperature in spin beam 3 by use of a temperature sensor 19, and, based on a comparison of set point and actual values, controls blower 13 and regeneration heating means 14.

During the regeneration process the spinning cans, not shown here, are removed from spinning can receivers 6 so that the openings in distribution lines 5 are open. An opening 2.1 is provided in melt feed line 2 through which compressed air can be blown into the melt feed line system. Alternatively, melt feed line 2 is connected via opening 2.1 to an exhaust device 2.2 by which the gases generated during the regeneration process are exhausted and filtered.

Residues in melt feed line 2 and distribution lines 5 which could not be completely removed by the regeneration process, i.e.; the polymer chains of which were not fully broken up to the gaseous form, are discharged by flushing the lines with polymer—not including the spinning packets used—following the regeneration process.

The regeneration heating may be permanently connected to the spin beam 3. However, it is also possible and practical for economic reasons to design filter 12, blower 13, regeneration heating means 14, and control means 15 to be removable so that they can be attached as needed to hot air feed 9 and hot air exhaust 10 of the spin beam 3 to be regenerated. Thus, a manufacturer of chemical fibers need have only one regeneration heating system on hand for a plurality of spin beams.

Although heating with heat transfer medium is illustrated in FIG. 1 as the operational heating system, the spin beam according to the invention also encompasses other embodiment forms of the operational heating system, such as (electrical) trace heating of the melt-conducting components, for example. These are known in the art. The same also applies to the figure which follows.

Figure 2:
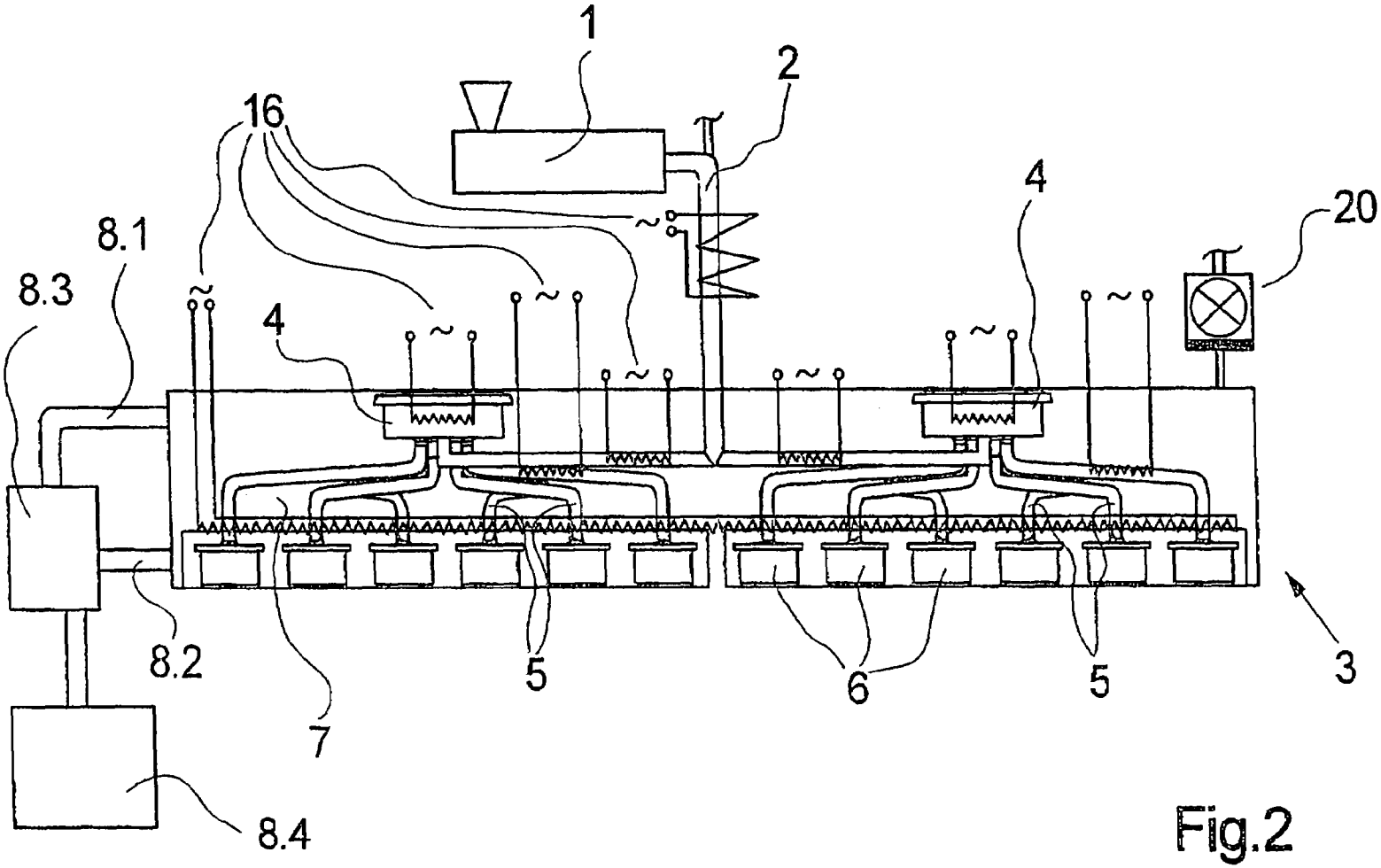
FIG. 2 shows a section through a variant of an apparatus for spinning melt-spun filament yarns according to the present invention.

FIG. 2 shows a variant of spin beam 3 illustrated in FIG. 1. In this case, regeneration heating means 16 are based on additional electrical heating of spin beam 3. Although hot air does not flow through the cavity in the spin beam here, a collection reservoir 8.4 for the heat transfer medium is nevertheless provided, since as a rule the heat transfer media used are not heat-resistant in the regeneration temperature range. Residues of the heat transfer medium remaining in spin beam 3 evaporate during the regeneration process and are discharged by an exhaust means 20.

The spin beam is typically well insulated from the outside, whereas the interior components conduct heat relatively well. In this manner, and by the heat radiation inside spin beam 3, a sufficiently uniform heat distribution is achieved, the requirements for uniformity of temperature being less stringent for the regeneration process than for the spinning operation. The number of regeneration heating means 16 and their particular location are deduced from the design of spin beam 3, and can be appropriately designed by one skilled in the art. Regeneration heating means 16 are designed as heating coils, heating rods, etc., and transfer the heat by means of heat conduction or heat radiation. Here as well, regeneration heating means 16 may be either permanently installed in spin beam 3 or designed to be interchangeable. With regard to heating rods in particular, it is possible to use these in openings in spin beam 3 which are provided specifically for this purpose and which are closed by stoppers during normal operation.

Figure 3:
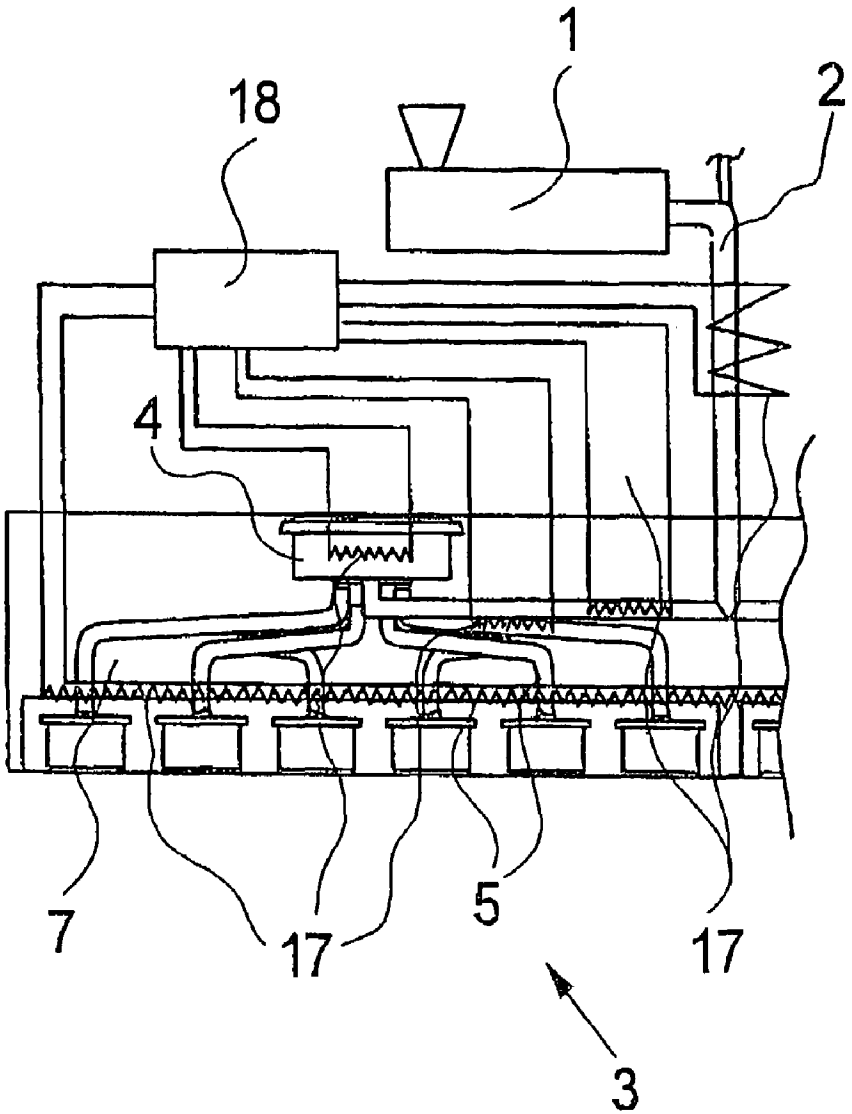
FIG. 3 shows a section through another variant of an apparatus for spinning melt-spun filament yarns according to the present invention.

FIG. 3 shows a further variant of the apparatus according to the invention for spinning 3. In contrast to the examples illustrated in the previous figures, heating of spin beam 3 during normal spinning operations (operational heating) is provided not by a heat transfer medium, but rather by heating means 17 to the individual melt-conducting parts, the heating means being designed here as trace heating. This may be electrical resistance heating, for example. Heating means 17 are controlled by control means 18 which include temperature regulation, for example. Control means 18 are provided with a separate operating mode in which the heating means can be operated at a higher regeneration temperature, so that the regeneration process can be simultaneously carried out using the operational heating means.

LIST OF REFERENCE NUMBERS

1. Extruder
2. Melt feed line
2.1 Opening
2.2 Exhaust means
3. Spin beam
4. Spinning pump
5. Distribution line
6. Spinning can receiver
7. Cavity
8.1 Heat transfer medium inlet
8.2 Heat transfer medium outlet
8.3 Operational heating means
8.4 Collection reservoir
9. Hot air feed
10. Hot air exhaust

11. Second hot air duct
12. Filter
13. Blower
14. Regeneration heating means
15. Control means
16. Regeneration heating means
17. Heating means
18. Control means
19. Temperature sensor
20. Exhaust means The disclosure in German Patent Application 102 58 261.0 of Dec. 13, 2002 is incorporated herein by reference. This German Patent Application describes the invention described hereinabove and claimed in the claims appended hereinbelow and provides the basis for a claim of priority for the instant invention under 35 U.S.C. 119.

While the invention has been illustrated and described as embodied in a spin beam, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An apparatus for melt spinning multifilament yarns, comprising a polymer melt generator for providing a polymer melt, a spin beam which includes a plurality of spinning nozzles, at least one spin pump connected to the polymer melt generator, and a plurality of distribution lines leading from the spin pump to respective ones of the spinning nozzles, an operational heater for directly heating the spin pump and the distribution lines of the spin beam to an operational temperature, and a separate regenerative heater for directly heating the spin pump and the distribution lines of the spin beam to a regeneration temperature above the operational temperature so as to convert any organic deposits in the pump and distribution lines to gases or vapors which may then be removed.

2. Apparatus according to claim 1, further including a controller for controlling the operation of the regenerative heater.

3. Apparatus according to claim 2, further including at least one temperature sensor in communication with the controller.

4. Apparatus according to claim 1, wherein the polymer melt generator comprises an extruder or a polycondensation reactor.

5. Apparatus according to claim 1, wherein the at least one spin pump is configured to meter the polymer melt to the spinning nozzles.

6. Apparatus according to claim 1, wherein the length of each of the plurality of distribution lines is substantially the same.

7. The apparatus according to claim 1, wherein the at least one spin pump and the plurality of distribution lines are housed within an enclosed cavity, and wherein the operational heater comprises a heat transfer medium and means for circulating the heat transfer medium through the cavity.

8. The apparatus according to claim 7 further comprising a collection reservoir for receiving the heat transfer medium from the cavity, and wherein the regenerative heater comprises means for circulating hot air through the cavity after the heat transfer medium has been transferred to the collection reservoir.

9. The apparatus according to claim 8, wherein the heat transfer medium comprises oil or Diphyl.

10. The apparatus according to claim 8, wherein the means for circulating hot air through the cavity comprises a blower and a filter capable of removing residue generated during the regeneration of the spin beam from the circulating hot air.

11. The apparatus according to claim 8, wherein the enclosed cavity includes an exhaust device for exhausting gases generated during a regeneration of the spin beam.

12. The apparatus according to claim 11, wherein the exhaust device includes a filter for filtering the gases generated during the regeneration of the spin beam.

13. The apparatus according to claim 1, wherein the operational heater is configured to heat the at least one spin pump and the distribution lines to an operational temperature of between about 250 to 330° C., and wherein the regenerative heater is configured to heat the at least one spin pump and the distribution lines to a regeneration temperature of between about 450 to 550° C.

14. The apparatus according to claim 1 wherein the regenerative heater is removably attached to the spin beam.

15. The apparatus according to claim 1 wherein the regenerative heater comprises electrical heating elements which are in contact with the at least one spin pump and the distribution lines.

16. The apparatus according to claim 1, wherein the at least one spin pump is connected to the polymer melt generator via a melt feed line, and wherein the apparatus further comprises means for heating the melt feed line to the regeneration temperature.

17. The apparatus according to claim 1 wherein the at least one spin pump and the plurality of distribution lines are housed within an enclosed cavity, and wherein the distribution lines are in the form of tubes which are positioned within the enclosed cavity.

* * * * *